US010928072B2

(12) United States Patent
SirLouis

(10) Patent No.: US 10,928,072 B2
(45) **Date of Patent: *Feb. 23, 2021**

(54) HINGE ASSEMBLY FOR OVEN OR OTHER APPLIANCE

(71) Applicant: Mansfield Engineered Components, Inc., Mansfield, OH (US)

(72) Inventor: Nicholas R. SirLouis, Seville, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/416,713

(22) Filed: May 20, 2019

(65) Prior Publication Data

US 2019/0271473 A1 Sep. 5, 2019

Related U.S. Application Data

(63) Continuation of application No. 15/246,030, filed on Aug. 24, 2016, now Pat. No. 10,295,194.

(60) Provisional application No. 62/209,337, filed on Aug. 24, 2015.

(51) Int. Cl.

| | |
|---|---|
| ***E05D 3/02*** | (2006.01) |
| ***F24C 15/02*** | (2006.01) |
| ***E05F 3/20*** | (2006.01) |
| ***E05F 1/12*** | (2006.01) |
| ***E05D 11/06*** | (2006.01) |
| ***E05F 5/10*** | (2006.01) |
| *A47L 15/42* | (2006.01) |
| *D06F 39/14* | (2006.01) |

(52) U.S. Cl.

CPC ..... *F24C 15/023* (2013.01); *E05D 3/02* (2013.01); *E05D 11/06* (2013.01); *E05F 1/1261* (2013.01); *E05F 3/20* (2013.01); *E05F 5/10* (2013.01); *A47L 15/4261* (2013.01); *D06F 39/14* (2013.01); *E05Y 2201/416* (2013.01); *E05Y 2900/30* (2013.01); *E05Y 2900/308* (2013.01)

(58) Field of Classification Search

CPC ..... E05D 3/02; E05D 11/06; E05F 1/1025; E05F 1/105; E05F 5/10

USPC ..... 16/84, 284–285, 289, 290, 335

See application file for complete search history.

(56) References Cited

U.S. PATENT DOCUMENTS

| | | | |
|---|---|---|---|
| 5,937,481 | A | 8/1999 | Faringosi |
| 6,397,836 | B1 | 6/2002 | Pelletier et al. |
| 6,789,293 | B2 | 9/2004 | Habegger et al. |
| 6,986,187 | B2 | 1/2006 | Cummins et al. |

(Continued)

*Primary Examiner* — Roberta S Delisle

(74) *Attorney, Agent, or Firm* — Fay Sharpe LLP

(57) ABSTRACT

An appliance hinge includes a control link subassembly operably connected between a base and a door mounting arm. The control link subassembly includes a control link with a first end pivotally connected to the door mounting arm and a second end spaced from the first end. The control link subassembly also includes a spring-arm including an outer end pivotally connected to the second end of the control link and an inner end engaged with the base and adapted for both pivoting and sliding movement relative to the base. The control link subassembly also includes a spring engaged with the spring-arm and exerting a biasing force on the spring-arm that urges said spring-arm toward its extended position. The spring-arm selectively moveable toward a retracted position. The hinge assembly further includes a link controller connected to the base. The spring biases the control link into abutment with the link controller.

20 Claims, 8 Drawing Sheets

(56) References Cited

U.S. PATENT DOCUMENTS

| | | | |
|---|---|---|---|
| 8,677,565 | B2 | 3/2014 | Vanini |
| 8,683,653 | B2 | 4/2014 | Bettinzoli |
| 8,925,542 | B2 | 1/2015 | White et al. |
| 9,080,364 | B2 | 7/2015 | Vanini |
| 9,157,262 | B2 | 10/2015 | Lee |
| 2003/0221285 | A1 | 12/2003 | Habegger et al. |
| 2010/0127606 | A1 | 5/2010 | Collene et al. |
| 2011/0316401 | A1 | 12/2011 | Cummins et al. |

HINGE ASSEMBLY FOR OVEN OR OTHER APPLIANCE

CROSS-REFERENCE TO RELATED APPLICATIONS

This application is a continuation of U.S. application Ser. No. 15/246,030 filed on Aug. 24, 2016, now assigned U.S. Pat. No. 10,295,194, which claims priority from and benefit of the filing date of U.S. provisional application Ser. No. 62/209,337 filed on Aug. 24, 2015, and the entire disclosure of each of said prior applications is hereby expressly incorporated by reference into the present specification.

FIELD

The present disclosure relates to the field of appliances and, more particularly, to a hinge assembly for use with an appliance such as an oven, dish washer, clothes washing machine, and the like, and relates to an appliance including one or more such hinge assemblies.

BACKGROUND

Hinge assemblies for appliances such as ovens, dish washers, clothes washing machines, and the like come in a wide variety of styles and structures. While many known hinge assemblies have enjoyed widespread commercial success and have proven to be safe, reliable, and cost-effective, a need has been identified for a new and improved hinge assembly for a cooking oven or similar appliance that provides a compact design for being installed in a confined space, is cost-effective in terms of its material cost and assembly costs, is durable, easily repairable, and that provides desired feel characteristics to the end user when opening and closing the appliance door.

SUMMARY OF THE PRESENT DISCLOSURE

According to one aspect of the present disclosure, an appliance hinge assembly includes a base and a door mounting arm pivotally connected to the base and adapted for pivoting movement relative to the base between a first position and a second position. A control link subassembly is operably connected between the base and the door mounting arm. The control link subassembly includes a control link comprising a first end pivotally connected to the door mounting arm and a second end spaced from the first end. The control link further includes first edge. The control link subassembly also includes a spring-arm comprising an outer end pivotally connected to the second end of the control link and an inner end engaged with the base and adapted for both pivoting and sliding movement relative to the base. The spring-arm is moveable between an extended position and a retracted position relative to the base. The control link subassembly also includes a spring engaged with the spring-arm and exerting a biasing force on the spring-arm that urges said spring-arm toward its extended position. The spring-arm selectively moveable against the biasing force toward its retracted position. The hinge assembly further includes a link controller connected to the base. The spring biases the first edge of the control link into abutment with the link controller. Pivoting movement of the door mounting arm relative to the base alters a contact location where the first edge of the control link contacts the link controller such that pivoting movement of the door mounting arm relative to the base induces pivoting movement of the control link relative to the door mounting arm to alter a door-closing force Fc exerted on the door mounting arm by the biasing spring through the control link.

In accordance with another aspect of the present development, an oven appliance includes a body comprising a chamber with an opening. A door is adapted to selectively close the chamber opening. First and second hinge assemblies pivotally connect the door to the body such that the door is adapted for pivoting movement relative to the body between a closed position where the door closes the chamber opening and an opened position where the door is moved away from the chamber opening. At least one of the hinge assemblies includes a base connected to the appliance body and a door mounting arm connected to the appliance door. The door mounting arm is pivotally connected to the base and adapted for pivoting movement relative to the base between a first position and a second position, wherein said first position corresponds to the closed position of the door and the second position corresponds to the opened position of the door. A control link subassembly is operably connected between the base and the door mounting arm, wherein the control link subassembly includes: (i) a control link comprising a first end pivotally connected to the door mounting arm and a second end spaced from the first end, said control link further comprising a first edge; (ii) a spring-arm comprising an outer end pivotally connected to the second end of the control link and comprising an inner end engaged with the base and adapted for both pivoting and sliding movement relative to the base, said spring-arm moveable between an extended position and a retracted position relative to said base; and (iii) a spring engaged with the spring-arm and exerting a biasing force on the spring-arm that urges said spring-arm toward its extended position, said spring-arm selectively moveable against the biasing force toward its retracted position. The at least one hinge assembly further includes a link controller connected to the base, wherein the spring biases the first edge of the control link into abutment with the link controller and pivoting movement of the door mounting arm relative to the base alters a contact location where the first edge of the control link contacts the link controller such that pivoting movement of the door mounting arm relative to the base induces pivoting movement of the control link relative to the door mounting arm to alter a door-closing force Fc exerted on the door mounting arm by the biasing spring through the control link.

DETAILED DESCRIPTION

Figure 2:
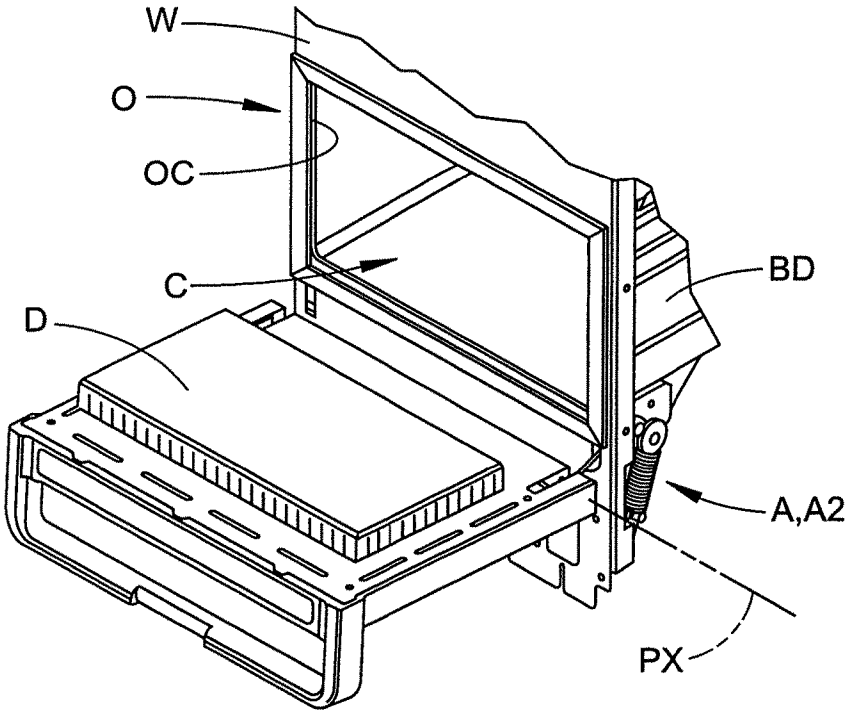
FIGS. 1 and 2 are left and right side partial isometric views of food preparation/cooking oven O including at least one hinge assembly A according an embodiment of the present development.
Figure 1:
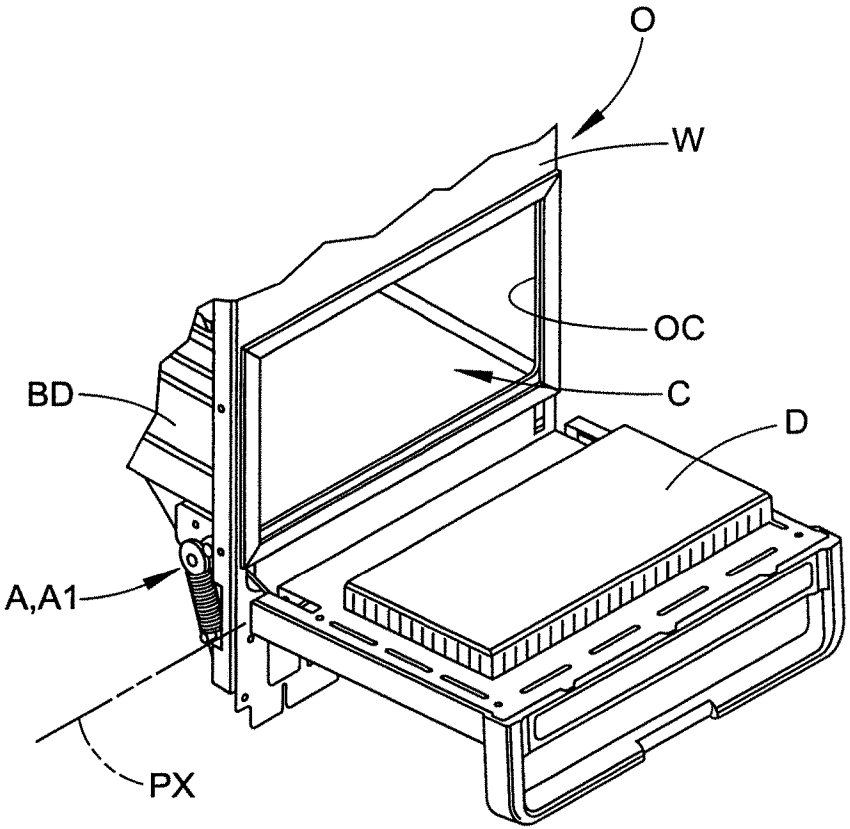

FIGS. 1 and 2 are left and right side partial isometric views of food preparation/cooking oven O including at least one hinge assembly A according an embodiment of the present development. The illustrated oven O comprises first and second hinge assemblies A, also labeled A1,A2, located adjacent first/left and second/right lateral sides of the oven O, respectively. As shown herein, the first and second hinge assemblies A1,A2 are mirror image structures with respect to each other, but they can be identical in structure. In another embodiment, described in detail below, either one or both of the first and second hinge assemblies A can alternatively or additionally comprise one or more fluid dampers that dampen movement of the hinge assembly in a first direction, a second direction, or both the first and second directions.

The oven O comprises a body BD that defines a cooking chamber C that opens through a front wall W or other wall of the body such that a cooking chamber opening OC is defined in the wall W. The oven O further comprises a door D that pivots about a door pivot axis PX (typically a horizontal axis) between a closed position where the door D covers/blocks the cooking chamber opening OC and an opened position (illustrated in FIGS. 1 and 2) in which the door D is moved away from the opening OC to allow access to the cooking chamber C through the opening OC.

Figure 3:
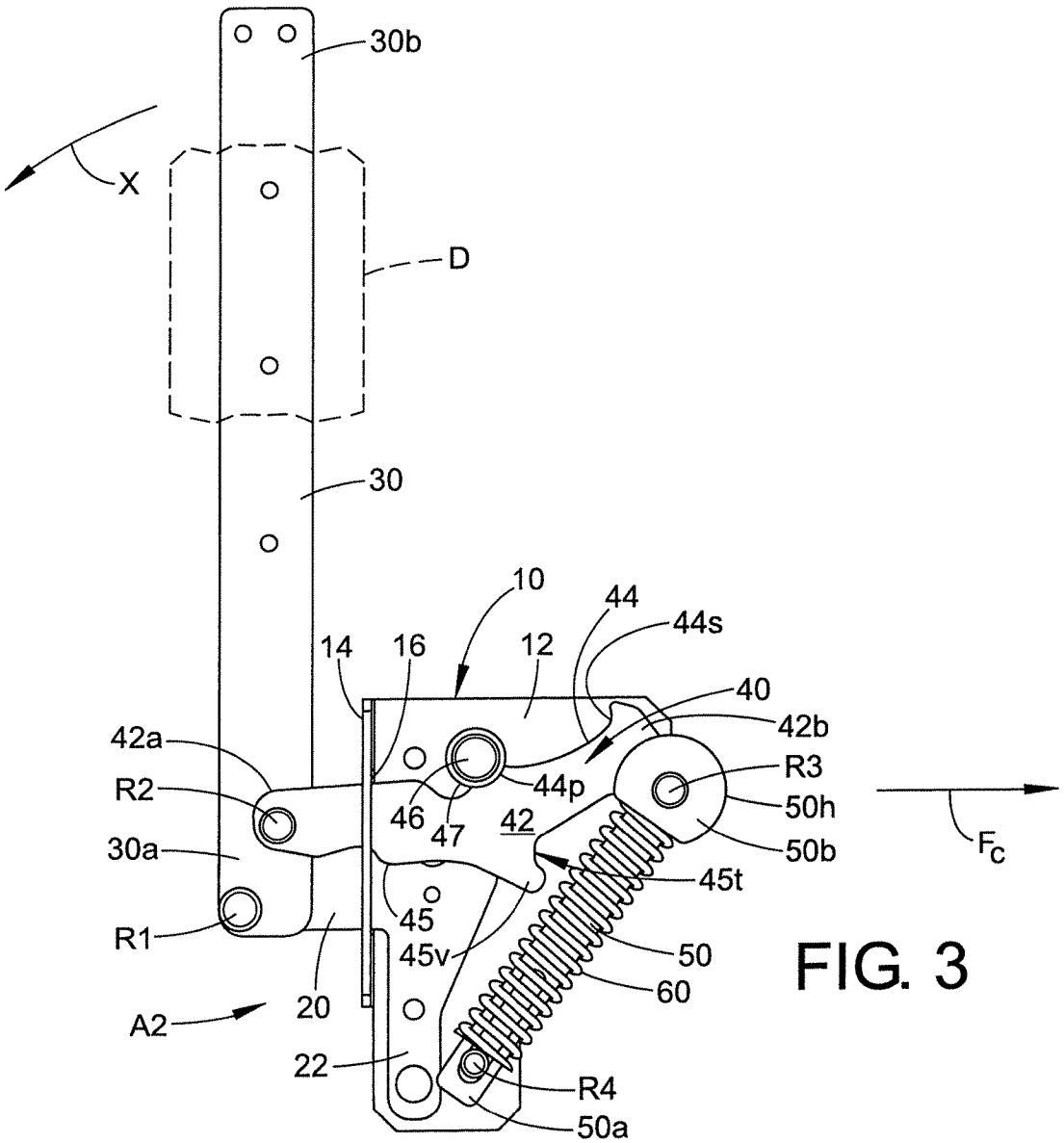
FIGS. 3, 4, and 5 are side views that illustrate the (right) hinge assembly A2 in its first (door closed), second (door opened), and third (intermediate) configurations or positions, corresponding respectively to the oven door being in its closed position, its opened position, and an intermediate position located between the closed and opened positions.
Figure 4:
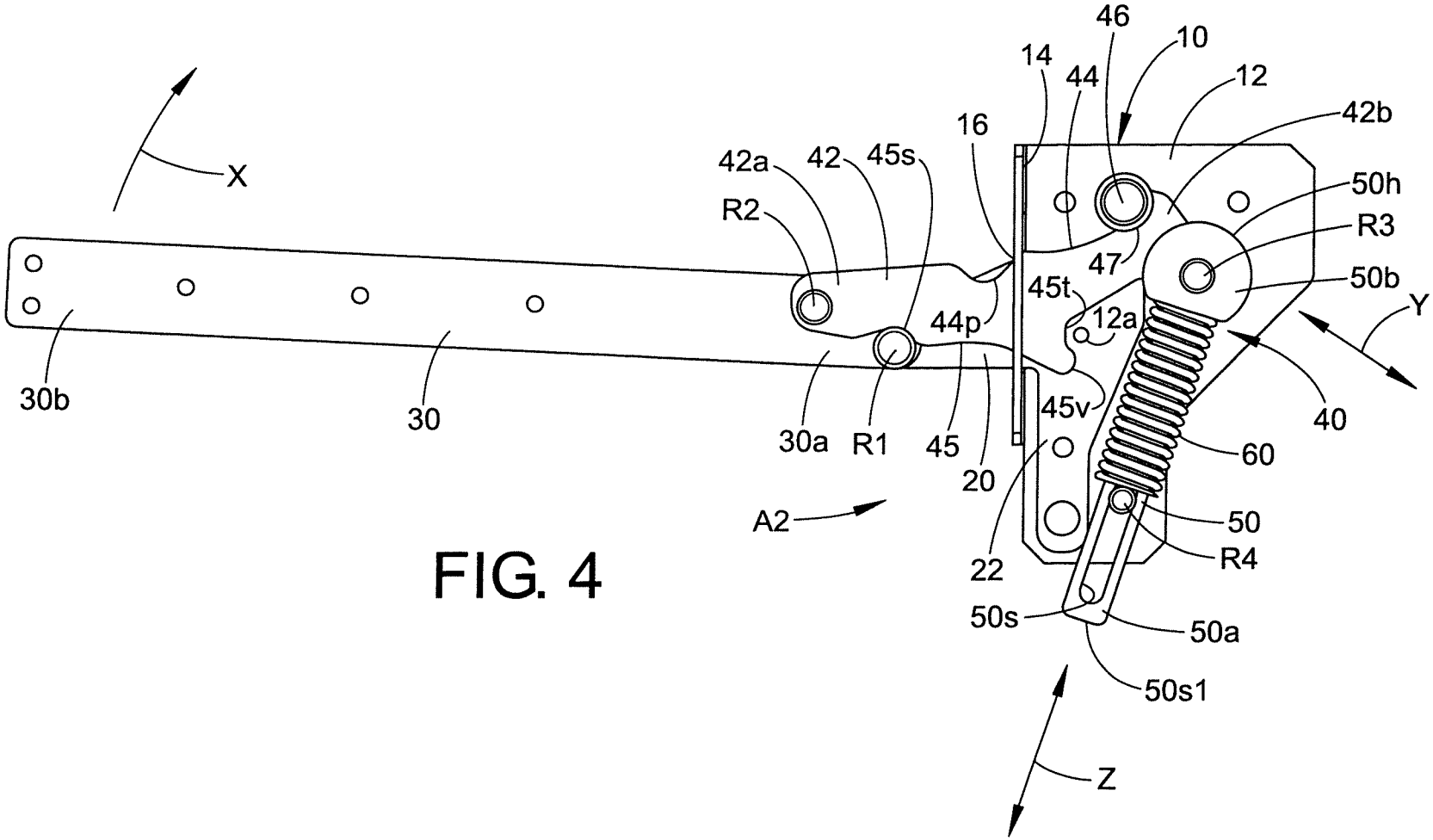
Figure 5:
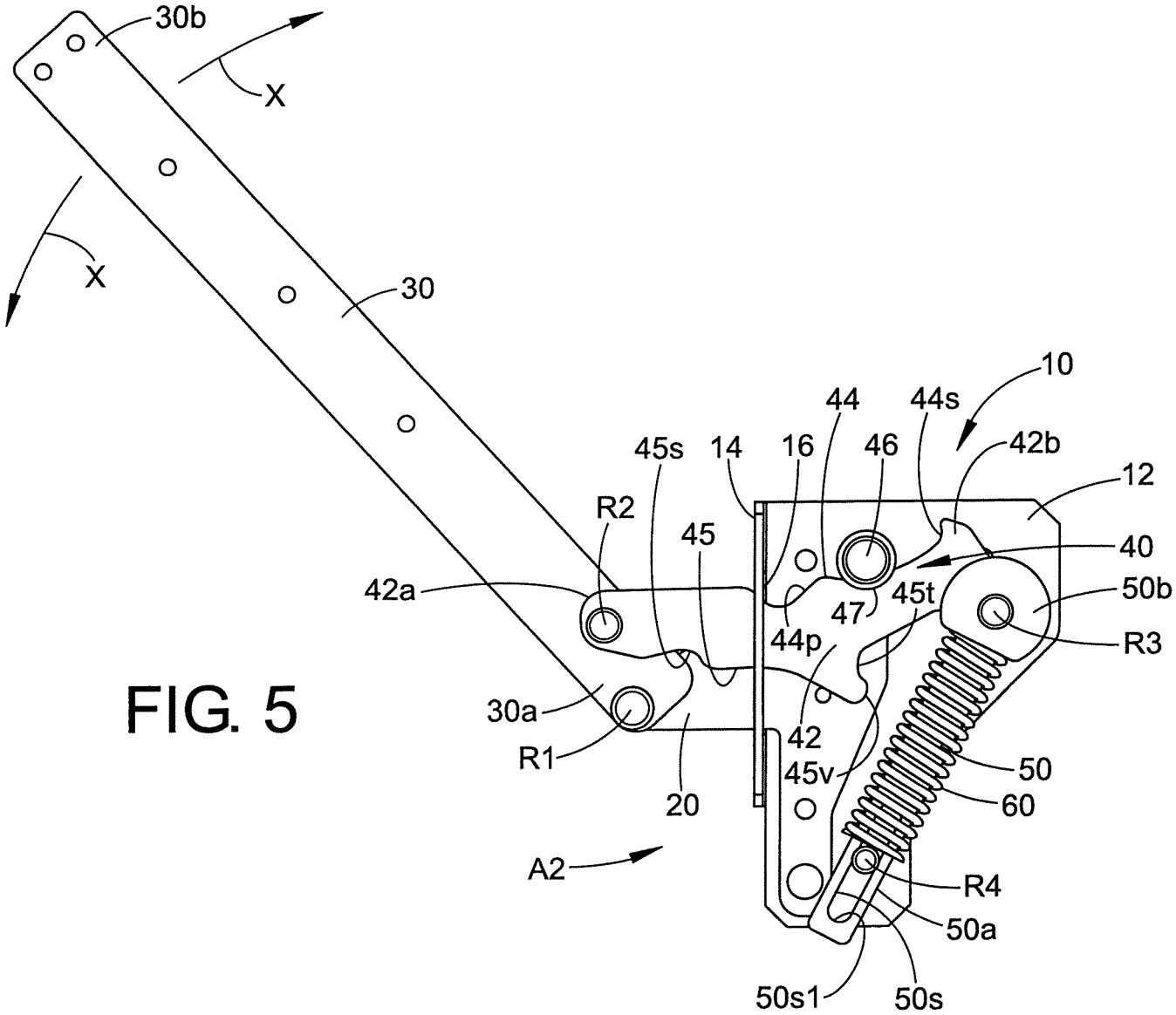
Figure 6:
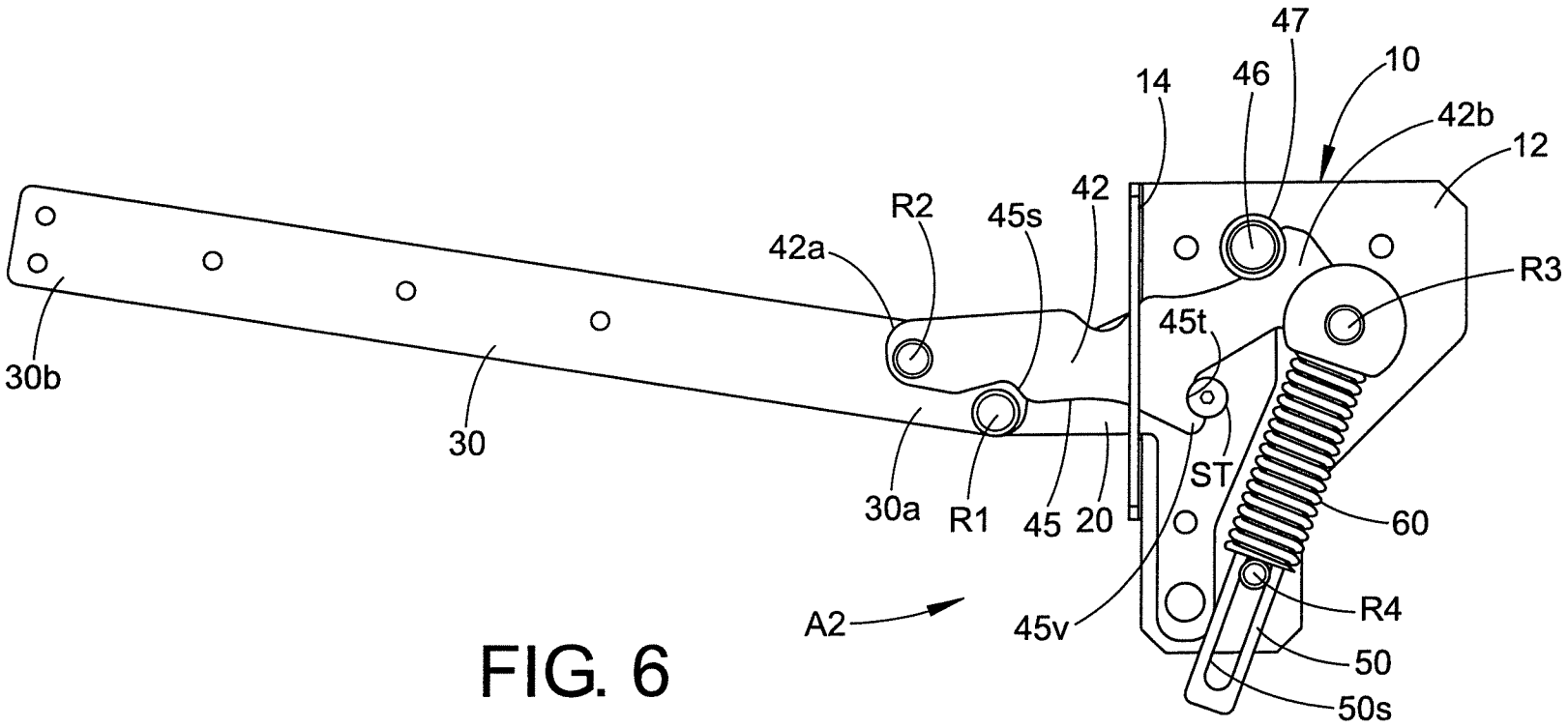
FIG. 6 shows the hinge assembly of FIGS. 3-5 in its temporary install/service configuration.
Figure 7:
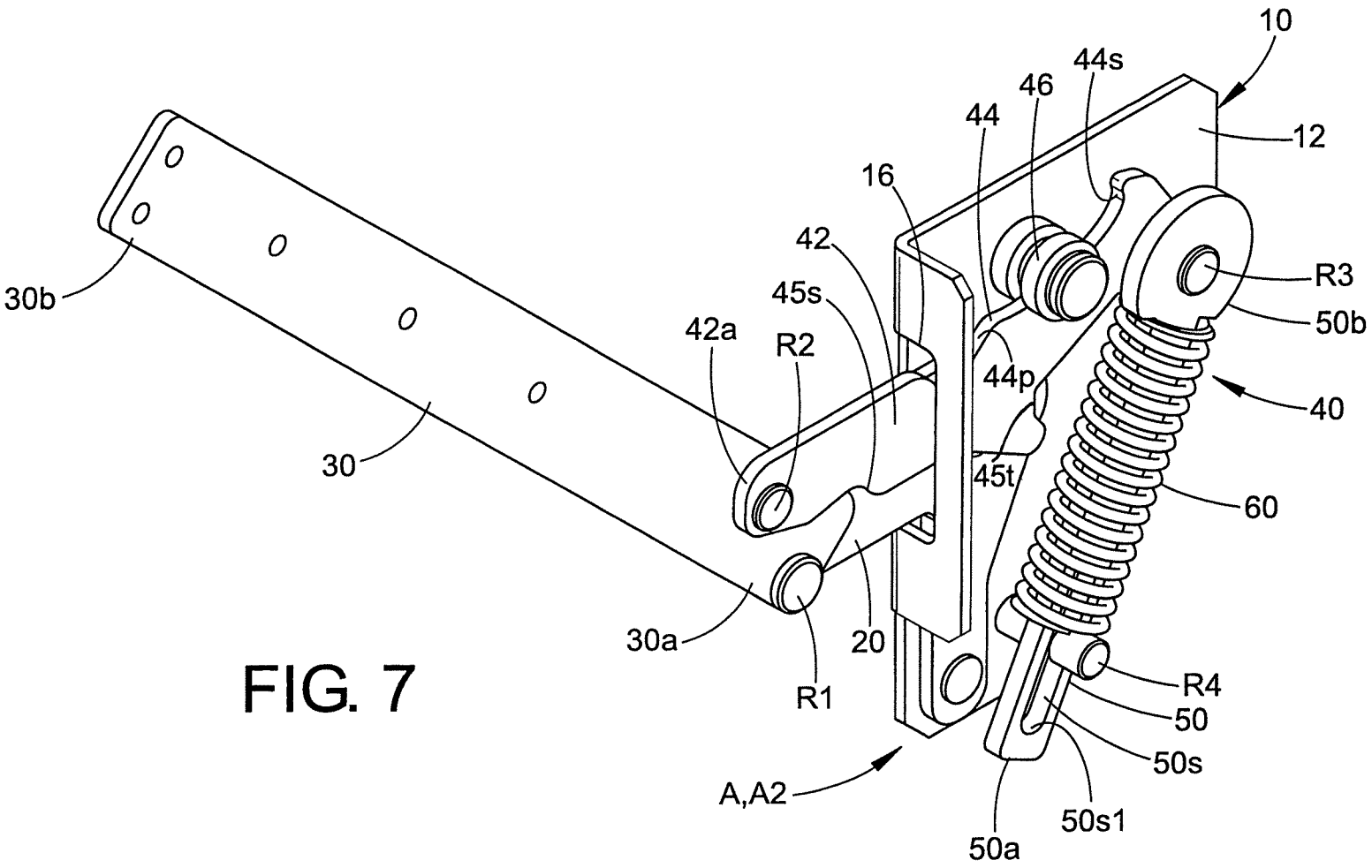
FIG. 7 is an isometric view of the hinge assembly in an intermediate position corresponding to FIG. 5.

FIGS. 3, 4, and 5 are side views that illustrate the (right) hinge assembly A2 in its first (door closed), second (door opened), and third (intermediate) configurations or positions, corresponding respectively to the oven door being in its closed position, its (fully) opened position, and an intermediate position located between the closed and opened positions (in some embodiments the door D will counterbalance in its intermediate position so as to provide a partially opened or "broil" position for the oven door D). FIG. 6 shows the hinge assembly A2 in its temporary install/service configuration. FIG. 7 is an isometric view of the hinge assembly A2 in an intermediate position.

Referring to all of FIGS. 3-7, each hinge assembly A comprises a base 10 comprising a main wall 12 and a front wall 14 that is oriented transversely relative to the main wall 12 and that projects outwardly from the main wall 12 adjacent a forward end of the main wall. The front wall 14 comprises an opening or slot 16. As shown herein, the main wall 12 and front wall 14 are defined together as a unitary, one-piece construction from a metal (steel) stamping or the like, but the front wall 14 can be a separate piece that is welded on otherwise connected to the main wall 12. The slot 16 can be a closed slot bounded on all sides by a portion of the base 10 or can be an open slot having at least one open side, i.e., a notch.

The base 10 also comprises a hinge arm mounting tab 20 that is connected to the main wall 12 and/or the front wall 14 and that projects outwardly relative to the main wall 12 and relative to the front wall 14 in a plane that is oriented parallel to the main wall 12. In the embodiment illustrated herein, the hinge arm mounting tab 20 is part of a hinge arm mounting wall 22 that is constructed separately from the main wall 12 and that is fixedly secured to the main wall 12 by welding, rivets or other fasteners, an adhesive, any other suitable means to define the base 10. In particular, in the illustrated embodiment, the mounting tab 20 of the hinge arm mounting wall 22 projects through the front wall slot 16. Alternatively, the base 10 including the main wall 12, front wall 14, and hinge arm mounting tab 20 are defined as a one-piece construction from a unitary or monolithic structure such as a single metal stamping, a cast structure, or the like.

The hinge assembly A further comprises a door mounting arm 30 including a first or inner end 30*a* pivotally connected to the mounting tab 20 of the base 10 by a rivet, other fastener, pin, or other main pivot member or main pivot structure R1 that defines the door pivot axis PX (FIGS. 1 & 2) about which the oven door D pivots between its closed and opened positions. The door mounting arm 30 also comprises a second or outer end 30*b* spaced outwardly from the inner end 30*a*. The door mounting arm 30 is adapted to be connected to the oven door D (FIG. 3) and supports the oven door D for pivoting movement to and between its closed and opened positions. In particular, the door mounting arm 30 pivots relative to the base 10 about the door pivot axis PX on an arc X between its first or door closed position (FIG. 3) and its second or door opened position (FIG. 4), through a third or intermediate position located between the first and second positions (FIGS. 5 & 7).

The hinge assembly A further comprises a control link subassembly 40 operatively connected between the base 10 and to the door mounting arm 30 for controlling the pivoting motion of the door mounting arm 30 relative to the base 10. The control link subassembly 40 comprises a control link 42 including a first or inner end 42*a* pivotally connected to the door mounting arm 30 by a rivet, pin, or other pivot member or control link pivot fastener R2 at a location near the main pivot fastener but spaced outwardly toward the outer end 30*b* as compared to the main pivot fastener R1. As such, the control link pivot fastener R2 is located between the main pivot fastener R1 and the outer end 30*b* of the door mounting arm 30. The opposite, second or outer end 42*b* of the control link 40 is spaced from the first/inner end 42*a* pivotally connected to an outer end 50*b* of a spring-rod or spring-arm 50 by a rivet, pin, or other pivot member or spring-arm pivot fastener R3. The inner end 50*a* of the spring-arm 50 is engaged with the base 10 and adapted to pivot and slide relative to the base 10. In the illustrated embodiment, the inner end of the spring-arm 50 comprises an elongated slot 50*s* (see FIGS. 4 & 5) that is pivotally and slidably engaged with a lower portion of the base 10 by way of a tab, finger, projection, rivet, pin, or other slide member or slide fastener R4. The slide fastener R4 is connected to or fixedly secured to the main wall 12 or other part of the base 10, or provided by a projection portion of the base 10, and projects outwardly from the main wall 12 of the base 10 and is slidably located in and engaged with the slot 50*s* of the spring-arm 50 such that the spring-arm is adapted to both pivot about the slide fastener R4 on an arc and slide axially along the axis of the slot 50*s* relative to the slide fastener R4 as indicated by respective arrows Y and Z (FIG. 4).

The control link subassembly 40 further comprises a biasing spring 60 that exerts a biasing force on the spring-arm 50 that biases the spring-arm 50 relative to the base 10 toward its extended position corresponding to the first (door closed) position of the door mounting arm 30 as shown in FIG. 3, where the outer end 50*b* of the spring-arm is spaced a maximum distance from the slide fastener R4 and where the slide fastener R4 is located at or near the inner end 50*s*1 of the slot 50*s*. As described in more detail below, the spring-arm 50 is selectively movable away from its extended position against the biasing force of the spring 60 toward and into its retracted position corresponding to the second (door opened) position of the door mounting arm 30 as show in FIG. 6, where the outer end 50*b* of the spring-arm 50 is moved closer to the slide fastener R4 as compared to the extended position of the spring-arm 50 and where the slide fastener R4 is spaced from the inner end 50*s*1 of the slot 50*s* and located closer to an opposite, outer end of the slot 50*s*. In the illustrated embodiment, the spring 60 comprises a helical coil spring that is coaxially positioned about the spring-arm 50 such that the spring-arm extends axially through the hollow core of the coil spring 60 and such that the spring 60 is operably located between the base 10 and the outer end 50*b* of the spring-arm whereby the spring 60 is operative as a compression spring that pushes or biases the spring-arm 50 toward its extended position. A first or inner end of the spring 60 is abutted or otherwise engaged with the slide fastener R4 or other part of the base 10, and the second our outer end of the spring 60 is abutted or otherwise engaged with the outer end 50*b* of the spring-arm 50, such that the spring urges the outer end 50*b* of the spring-arm 50 away from the slide fastener R4. The spring 60 can alternatively be installed as a tension spring that pulls the spring-arm 50 toward its extended position. In the illustrated embodiment, the spring-arm outer end 50*b* comprises an enlarged head 50*h* to facilitate contact with or detection by a switch connected to the oven O for sensing the position of the spring-arm 50.

The control link 42 comprises a first, upper or outer link edge 44 that is contoured and oriented to face outwardly away from the slide fastener R4. The link edge 44 is abutted with a link controller or link control structure or link control member 46 such as a roller, bushing, or slide/slide member that is fixedly secured to or otherwise connected to and/or provided as part of base 10. In the illustrated embodiment, the link control member 46 comprises a roller 47 secured to but spaced outwardly from the main wall 12 of the base by a pin, rivet, or other control fastener such that the roller is rotatable relative to the main wall 12. As noted, the link control member 46 can alternatively comprises a non-rotatable structure secured to the main wall 12 or other part of the base 10 such as a tab or other projection of the main wall 12 or other part of the base. Although a single rigid control link 42 is shown herein, multiple control links 42 can be used, either stacked in alignment with each other and/or pivotally interconnected to form an articulating linkage that defines the control link 42.

The spring 60 biases the first or upper link edge 44 into continuous abutment with the link control member 46 and biases the control link 42 inwardly away from the front wall 14 of the base 10. Movement of the oven door D between its closed and opened positions induces or causes corresponding movement of the door mounting arm 30 between its first (closed door) and second (opened door) positions. Such movement of the door mounting arm 30 between its first and second positions results in translation of the link 42 relative to the link control member/link controller 46, which is in contact with the contoured link edge 44 such that pivoting movement of the door mounting arm 30 relative to the base 10 alters a contact location where the contoured first edge 44 of the control link 42 contacts the link controller 46. The action of the contoured link edge 44 against the roller or other link control member 46 induces pivoting movement of the link 42 relative to the door mounting arm 30 which alters the counterbalance or door-closing force Fc exerted on the door mounting arm 30 by the biasing spring 60 through the control link 42.

The first control link edge 44 comprises a pull-in edge 44*p* that engages the control member 46 when the door mounting arm 30 is in its first (door closed) position as shown in FIG. 3, and shape of the pull-in edge is such that the action of the biasing spring 60 urging the link edge 44 against the door control member 46 when the control member 46 is located in contact with the pull-in edge 44*p* increases the door closing force FC to ensure that the oven door D closes completely and seals the cooking chamber opening OC.

The first control link edge 44 also comprises a stop 44*s* located adjacent its outer end 42*b*. The stop 44*s* comprises a raised portion or raised lobe defined in the link edge 44. The control link 42 further comprises a second or lower edge 45 located opposite the first edge 44. When the door mounting arm 30 is moved to its second (door opened) position as shown in FIG. 4, the second link edge 45 conformed and located to abut the main pivot fastener R1 or other fixed location of the base 10 while the link control roller or other link control member 46 is abutted with the stop 44*s* of the first/upper link edge 44, such that further movement of the door mounting arm 30 away from its first (door closed) position is not possible due to the control link 42 being immovably captured or trapped between the control member 46 and the main pivot fastener R1. The second/lower edge 45 preferably includes a recessed stop location 45*s* conformed to closely receive the main pivot fastener R1 when the door mounting arm 30 is moved to its second position as shown in FIG. 4.

The second/lower link edge 45 further comprises a secondary stop location 45*t* used for installation and/or repair service of the hinge assembly A and/or installation or removal of the door D or the like. The secondary stop location 45*t* comprises a stop lobe 45*v* that projects outwardly from the second edge 45. The main wall 12 or other portion of the base 10 comprises a stop aperture 12*a* (FIG. 4) or other location for selectively receiving and retaining a pin, fastener, or other associated temporary stop member ST as shown in FIG. 6. To use the secondary stop location 45*t*, the door mounting arm 30 is first moved toward its second (door opened) position sufficiently to locate the stop lobe 45*v* on the outward or forward side of the stop aperture 12*a*, i.e., on the side closest to the front wall 14 of the base. The temporary stop member ST is then installed in the stop aperture 12*a*. Upon release of the door mounting arm 30, the stop lobe 45*v* abuts the stop member ST such that the control link 42 is blocked from moving further inward away from the front wall 14 as required for the door mounting arm 30 to return to its first (door closed) position from its second (door opened) position.

Figure 8:
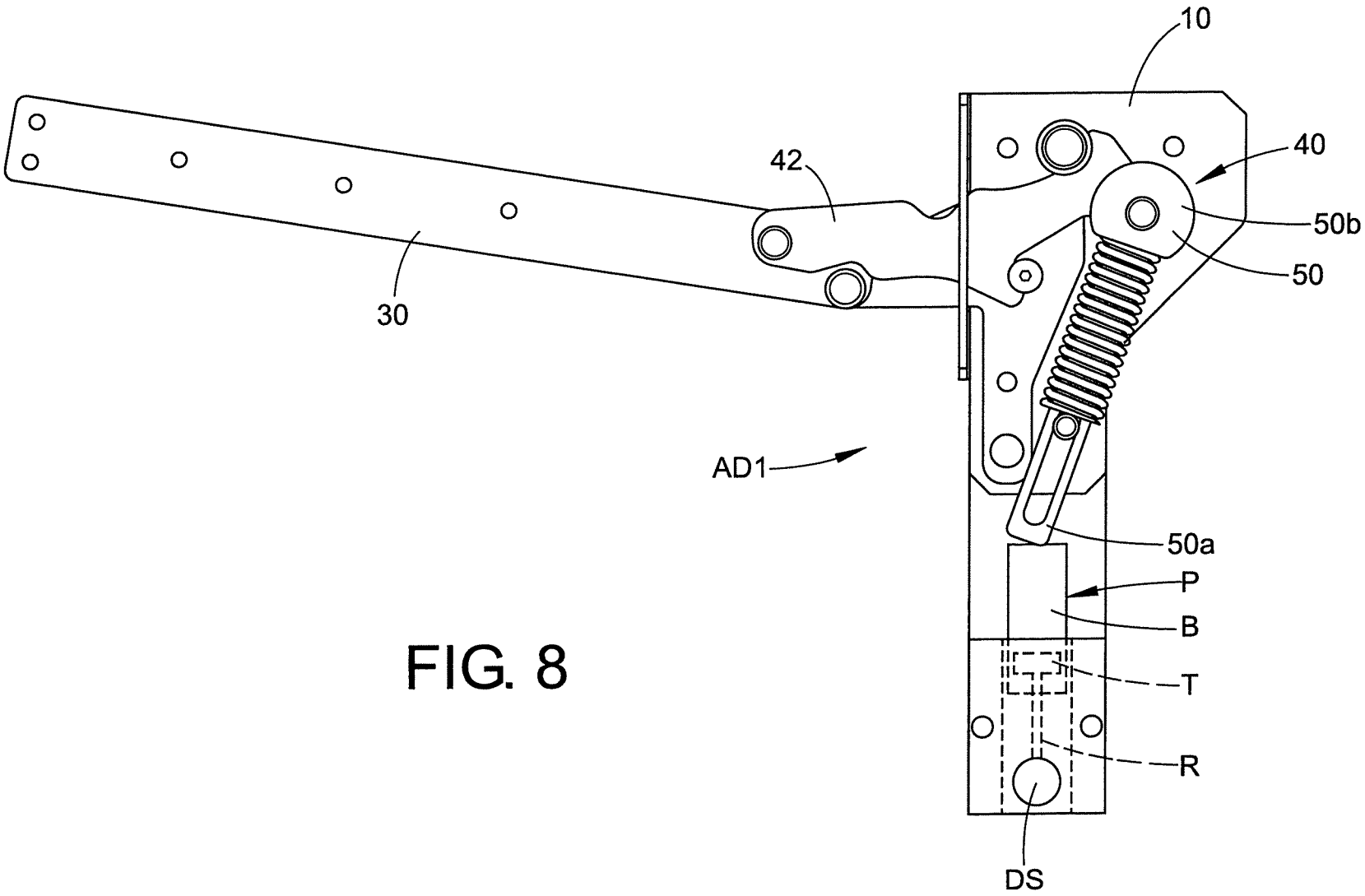
FIG. 8 is a side view of an alternative embodiment of a hinge assembly in accordance with the present disclosure that includes an optional damper.

In another embodiment of a hinge assembly formed in accordance with the present development as shown at AD1 in FIG. 8, the hinge assembly A can additionally comprise a damper such as fluid damper P that dampens or cushions movement of the control link subassembly 40 and the door mounting arm 30 when the door mounting arm 30 moves from its first (door closed) position toward its second (door opened) position. In the illustrated embodiment, the damper P comprises a body B filled with air, oil or another damping fluid, and a piston T is slidably located within the body B. The damper body B is secured to the main wall 12 or other part of the base 10 and is abutted with a damper stop DS connected to the base 10. A piston rod R is connected to the piston T and extends outward from an end of the damper body B. The piston T is configured such that the fluid damps movement of the piston T at least in one direction (at least on its inward stroke in the illustrated embodiment), and the damper P is located such that the first or inner end 50*a* of the spring-arm 50 will abut the damper P and cause movement of the damper body B relative to the piston T for at least part of the range of motion of the door mounting arm 30 as the door mounting arm is pivoted from its first (door closed) position toward its second position (door opened) such that the damper P provides resistance to movement of the door mounting arm 30 toward its second position. As shown in FIG. 8, the damper P is oriented such that the spring-arm 50 abuts the damper body B, but the orientation of the damper P can be reversed such that the spring-arm 50 abuts the piston rod R and moves the piston T inward relative to the damper body B while the damper body B is abutted with the fixed damper stop DS.

Figure 9:
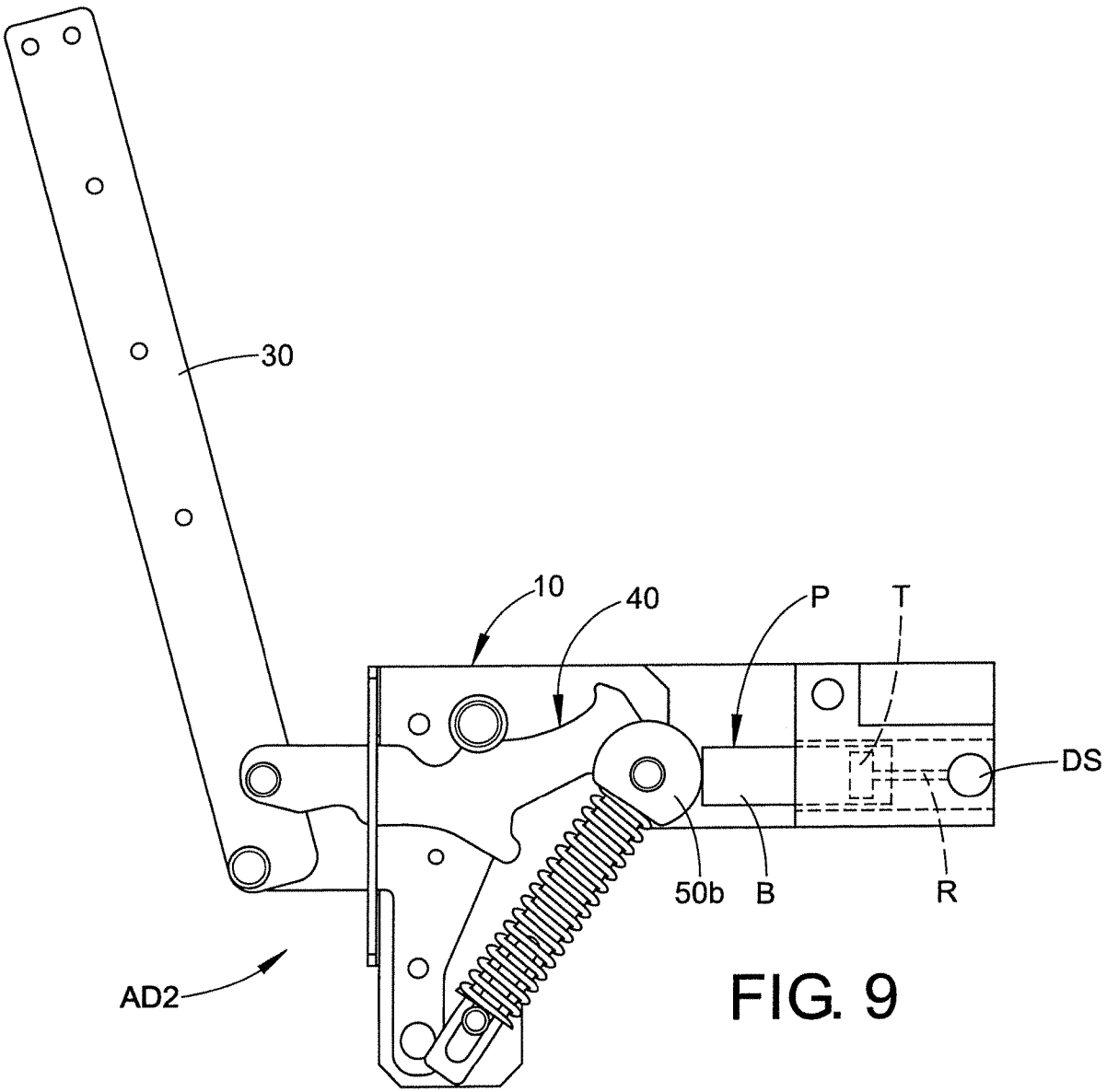
FIG. 9 is a side view of another alternative embodiment of a hinge assembly in accordance with the present disclosure that includes an optional damper.

FIG. 9 shows another hinge assembly AD2 constructed in accordance with an alternative embodiment in which a damper P as described above is alternatively or additionally provided to damp or cushion movement of the control link subassembly 40 and the door mounting arm 30 during movement of the door mounting arm 30 from its second (door opened) position toward its first (door closed) position. In such case, the fluid or other damper P is located such that the second or outer end 50*b* of the spring-arm abuts the damper body B for at least part of the range of motion of the door mounting arm 30 as the door mounting arm 30 moves from its second position toward its first position. A fixed damper stop DS is connected to the base 10 and prevents movement of the piston rod R relative to the base 10. Here again, as shown in FIG. 8, the damper P is oriented such that the spring-arm 50 abuts the damper body B, but the orientation of the damper P can be reversed such that the spring-arm 50 abuts the piston rod R and the damper stop DS prevents movement of the damper body B relative to the base 10.

In one embodiment of the oven O, one of the hinge assemblies A1,A2 comprises a damper P located as described in relation to FIG. 8, and the other of the hinge assemblies comprises a damper located as described in relation to FIG. 9, such that one of the hinge assemblies A1,A2 provides for damped movement of oven door D during door opening and the other of the hinge assemblies provides for damped movement of the oven door D during door closing. Alternatively, either one of both of the hinge assemblies A1,A2 comprises two dampers P: (i) a first damper P installed in accordance with the embodiment of FIG. 8 and a second damper P installed in accordance with the embodiment of FIG. 9, such that the first damper P installed in accordance with FIG. 8 provides damped movement during movement of the door D/door mounting arm 30 from the first position to the second position and the second dampers P installed in accordance with FIG. 9 provides damped movement during movement of the door D/door mounting arm 30 from the second position to the first position.

The present development has been described with reference to preferred embodiments. Modifications and alterations will occur to those of ordinary skill in the art to which the present development pertains, and it is intended that the claims be construed as broadly as possible to encompass all such modifications and alterations while preserving the validity of the claims.

The invention claimed is:

1. An appliance hinge assembly comprising:

a base;

a door mounting arm pivotally connected to the base and adapted for pivoting movement relative to the base between a first position and a second position;

a control link subassembly operably connected between the base and the door mounting arm, said control link subassembly comprising:

a control link comprising a first end pivotally connected to the door mounting arm and a second end spaced from the first end, said control link further comprising a first edge;

a spring-arm comprising an outer end pivotally connected to the second end of the control link and comprising an inner end engaged with the base, wherein said inner end of said spring-arm both pivots on an arc relative to the base and slides axially along an axis of the spring-arm relative to the base, said spring-arm moveable between an extended position and a retracted position relative to said base;

a spring engaged with the spring-arm and exerting a biasing force on the spring-arm that urges said spring-arm toward its extended position, said spring-arm selectively moveable against the biasing force toward its retracted position;

a link controller connected to the base, wherein said spring biases the first edge of the control link into abutment with the link controller and pivoting movement of said door mounting arm relative to the base alters a contact location where said first edge of the control link contacts the link controller such that pivoting movement of the door mounting arm relative to the base induces pivoting movement of the control link relative to the door mounting arm to alter a door-closing force FC exerted on the door mounting arm by the biasing spring through the control link.

2. The appliance hinge assembly as set forth in claim 1, wherein said inner end of said spring arm comprises an elongated slot, and wherein said appliance hinge assembly further comprises a slide fastener that projects outwardly from the base and that is slidably located in the elongated slot of the spring-arm such that the spring-arm is adapted to both pivot about the slide fastener on an arc and slide axially along the axis of the slot relative to the slide fastener.

3. The appliance hinge assembly as set forth in claim 2, wherein the slide fastener comprises a rivet connected to the base.

4. The appliance hinge assembly as set forth in claim 2, wherein the spring comprises a coil spring coaxially positioned on the spring arm such that the spring-arm extends axially through a hollow core of the coil spring whereby the spring is operably located between the base and the outer end of the spring-arm such that the spring is operative as a compression spring to bias the spring-arm toward its extended position.

5. The appliance hinge assembly as set forth in claim 2, wherein the first edge of the control link comprises a stop located adjacent the outer end of the control link, wherein the stop comprises a raised portion defined in the first edge that contacts the link controller when the door mounting arm is moved to its second position.

6. The appliance hinge assembly as set forth in claim 5, wherein the control link further comprises a second edge located opposite the first edge, and wherein the second edge abuts a fixed location of the base when the door mounting arm is moved to its second position and said link controller is in contact with said stop.

7. The appliance hinge assembly as set forth in claim 5 wherein:

the door mounting arm is pivotally connected to the base by a main pivot fastener;

the control link further comprises a second edge located opposite the first edge; and, the second edge of the control link abuts the main pivot fastener when the door mounting arm is moved to its second position and when said link controller is in contact with said stop.

8. The appliance hinge assembly as set forth in claim 5, wherein the control link further comprises a second edge located opposite the first edge, and wherein the second edge comprises a secondary stop location comprising a stop lobe that projects outwardly from the second edge, and wherein the main wall of the base comprises a stop aperture for selectively receiving an associated temporary stop member that abuts the secondary stop location of the control link such that the control link is blocked from moving inwardly as required for the door mounting arm to return to its first position from its second position.

9. The appliance hinge assembly as set forth in claim 1, wherein the base comprises a main wall and a front wall oriented transversely relative to the main wall, and wherein the front wall comprises an opening or slot through which the control link extends.

10. The appliance hinge assembly as set forth in claim 1, wherein the base is connected to the body of an oven appliance and the door mounting arm is connected to a door of the oven appliance.

11. The appliance hinge assembly as set forth in claim 1, further comprising a first fluid damper connected to the base and operably positioned to be engaged by the spring-arm during at least a portion of movement of the door mounting arm from its first position to its second position.

12. The appliance hinge assembly as set forth in claim 11, further comprising a second damper connected to the base and operably positioned to be engaged by the spring-arm during at least a portion of movement of the door mounting arm from its second position to its first position.

13. The appliance hinge assembly as set forth in claim 11, further comprising a damper connected to the base and operably positioned to be engaged by the spring-arm during at least a portion of movement of the door mounting arm from its second position to its first position.

14. An oven appliance comprising:

a body including a chamber with an opening;

a door adapted to selectively close the chamber opening;

first and second hinge assemblies that pivotally connect the door to the body such that the door is adapted for pivoting movement relative to the body between a closed position where the door closes the chamber opening and an opened position where the door is moved away from the chamber opening, at least one of the hinge assemblies comprising:

a base connected to the appliance body;

a door mounting arm connected to the appliance door, said door mounting arm pivotally connected to the base and adapted for pivoting movement relative to the base between a first position and a second position, wherein said first position corresponds to the closed position of the door and the second position corresponds to the opened position of the door;

a control link subassembly operably connected between the base and the door mounting arm, said control link subassembly comprising:

a control link comprising a first end pivotally connected to the door mounting arm and a second end spaced from the first end, said control link further comprising a first edge;

a spring-arm comprising an outer end pivotally connected to the second end of the control link and comprising an inner end connected to the base by a pivoting and sliding connection configured such that said inner end of said spring-arm both pivots on an arc relative to the base and slides axially along an axis of the spring-arm relative to the base, said spring-arm moveable between an extended position and a retracted position relative to said base;

a spring engaged with the spring-arm and exerting a biasing force on the spring-arm that urges said spring-arm toward its extended position, said spring-arm selectively moveable against the biasing force toward its retracted position;

a link controller connected to the base, wherein said spring biases the first edge of the control link into abutment with the link controller and pivoting movement of said door mounting arm relative to the base alters a contact location where said first edge of the control link contacts the link controller such that pivoting movement of the door mounting arm relative to the base induces pivoting movement of the control link relative to the door mounting arm to alter a door-closing force FC exerted on the door mounting arm by the biasing spring through the control link.

15. The oven appliance as set forth in claim 14, wherein said inner end of said spring arm comprises an elongated slot, and wherein said at least one hinge assembly further comprises a slide fastener that projects outwardly from the base and that is slidably located in the elongated slot of the spring-arm such that the spring-arm is adapted to both pivot about the slide fastener on an arc and slide axially along the axis of the slot 50*s* relative to the slide fastener.

16. The oven appliance as set forth in claim 15, wherein the slide fastener comprises a rivet connected to the base.

17. The oven appliance as set forth in claim 15, wherein the spring comprises a coil spring coaxially positioned on the spring arm such that the spring-arm extends axially through a hollow core of the coil spring whereby the spring is operably located between the base and the outer end of the spring-arm such that the spring is operative as a compression spring to bias the spring-arm toward its extended position.

18. The oven appliance as set forth in claim 15, wherein the first edge of the control link comprises a stop located adjacent the outer end of the control link, wherein the stop comprises a raised portion defined in the first edge that contacts the link controller when the door mounting arm is moved to its second position.

19. The oven appliance as set forth in claim 18, wherein the control link further comprises a second edge located opposite the first edge, and wherein the second edge abuts a fixed location of the base when the door mounting arm is moved to its second position and said link controller is in contact with said stop.

20. The oven appliance as set forth in claim 14, further comprising a fluid damper connected to the base and adapted to be engaged by the spring-arm when the door mounting arm is pivoted such that the damper cushions movement of the door mounting arm.

* * * * *